US005918979A

United States Patent [19]

Martin et al.

[11] Patent Number: 5,918,979

[45] Date of Patent: Jul. 6, 1999

[54] COMBINATION MECHANICAL ROTATOR-ROCKER

[75] Inventors: Matthew R. Martin, Remsenburg; James M. Kandora, Port Jefferson Station, both of N.Y.

[73] Assignee: Scientific Industries Inc., Bohemia, N.Y.

[21] Appl. No.: 09/027,267

[22] Filed: Feb. 20, 1998

Related U.S. Application Data

[ 60] Provisional application No. 60/039,396, Feb. 27, 1997.

[51] Int. Cl.[6] ..... B01F 11/00

[52] U.S. Cl. ..... 366/211; 366/214

[58] Field of Search ..... 366/208–216, 366/219

[56] References Cited

U.S. PATENT DOCUMENTS 3,625,485 12/1971 Adler .

5,167,928 12/1992 Kelly et al. ..... 366/208

5,322,358 6/1994 Coho et al. ..... 366/214

*Primary Examiner*—Charles E. Cooley

*Attorney, Agent, or Firm*—Ostrolenk, Faber, Gerb & Soffen, LLP

[57] ABSTRACT

A combined rotator and rocker for agitating contained materials includes a base having opposite sides, a drum having at least one object supporting side surface, a pair of opposite end surfaces, and a central axis passing through the end surfaces. The drum is rotatably coupled to the opposite side portions of the base. The drum is laterally movable along the central axis such that (i) in a first lateral position, the drum is continuously rotatable about the central axis; and (ii) in a second lateral position, the drum swings through an arc about the central axis. The drum is adapted to receive the contained materials in a plurality of different orientations to permit many different mixing motions.

57 Claims, 8 Drawing Sheets

COMBINATION MECHANICAL ROTATOR-ROCKER

CROSS REFERENCE TO RELATED APPLICATIONS

This application is based on, and claims priority to, U.S. Provisional Patent Application No. 60/039,396, filed Feb. 27, 1997, entitled COMBINATION MECHANICAL ROTATOR-ROCKER.

This application is related to U.S. Provisional Patent Application No. 60/039,394, filed Feb. 27, 1997, entitled A ROTATING TRIANGULAR DRUM FOR INCUBATING PROBES WITH MEMBRANE-IMMOBILIZED LIGANDS.

BACKGROUND

1. Field of the Invention

The present invention relates to a combination of: (i) a rotator for mixing materials within containers supported by the rotator; (ii) a rocker for repeatedly tilting a tray containing liquid for agitating the liquid and/or washing the liquid over another medium in the tray; and (iii) a means for mounting the containers in many different orientations to produce different mixing actions.

2. Related Art

Rotators are used in laboratories to repeatedly invert tubes and like vessels containing material in order to mix the contained material. Such rotators typically include a drum having holes in it for receiving the tubes and a directly driven, variable speed, gear motor to rotate the drum at various speeds.

Among known machines used in laboratories are machines used to roll tubes, machines used to shake tubes, and machines used to roll and/or tumble tubes in a combination motion.

Rockers are used in laboratories to repeatedly tilt a tray containing a liquid and/or material back and forth to agitate the material and/or wash the material across another medium within the tray. The tray is also typically driven by a variable speed gear motor coupled to a slider crank type mechanism to tilt the tray at various speeds.

A rotator or a rocker is usually driven by a DC motor with speed control obtained through varying the input voltage.

Some machines are capable of either rotating or rocking the material. To convert between a rotator and a rocker, the drum of the rotator is replaced with a platform which holds a tray, or vice versa. When acting as a rocker, the tray is tilted by repeatedly reversing the motor after the platform has tilted through a predetermined arc in each opposite direction. However, this requires accurately gauging the platform orientation and requires undesired motor reversals. Accurately gauging tilt orientation requires costly and complex electrical and/or mechanical systems. Periodic reversal of a motor exposes it to increased failure modes and excessive wear.

The machines of the prior art have not heretofore employed a means for securing a container containing material to be agitated which is capable of mounting the container in may different orientations.

Accordingly, there is a need in the art for a combined rotator and rocker machine which is capable of retaining containers for rotation and/or rocking in many different orientations and which does not suffer from the drawbacks of the prior art machines.

SUMMARY OF THE INVENTION

The invention can be used as either a rotator or a rocker. Instead of reversing the motor to tilt the platform in the rocker mode, a simple mechanical means transforms the direct drive used by the rotator to a slider crank type mechanism used by a rocker. A rotatable drum, e.g., a tube holder, is unlocked and shifted on its axis to engage an eccentric pin in a slot to transform the mechanism into a rocker. A platform to hold various trays to be rocked is added to complete the transformation.

The combined rotator and rocker of the invention includes a base having first and second opposite side portions. A drum is rotatably coupled to the side portions of the base. The drum has at least one operative side or surface adapted for receiving the contained material, a pair of opposite end surfaces toward the side portions of the base, and a central axis passing through the end surfaces. The drum is laterally movable along its central axis such that (i) in a first lateral position, the drum is fully rotatable about the central axis; and (ii) in a second lateral position, the drum may swing back and forth through only a limited arc about the central axis.

The rotator and rocker employs a retaining device capable of mounting the contained material in a plurality of orientations to obtain different mixing motions.

Other features and advantages of the present invention will become apparent from the following description of the invention which refers to the accompanying drawings.

DETAILED DESCRIPTION OF THE PREFERRED EMBODIMENT

Figure 1:
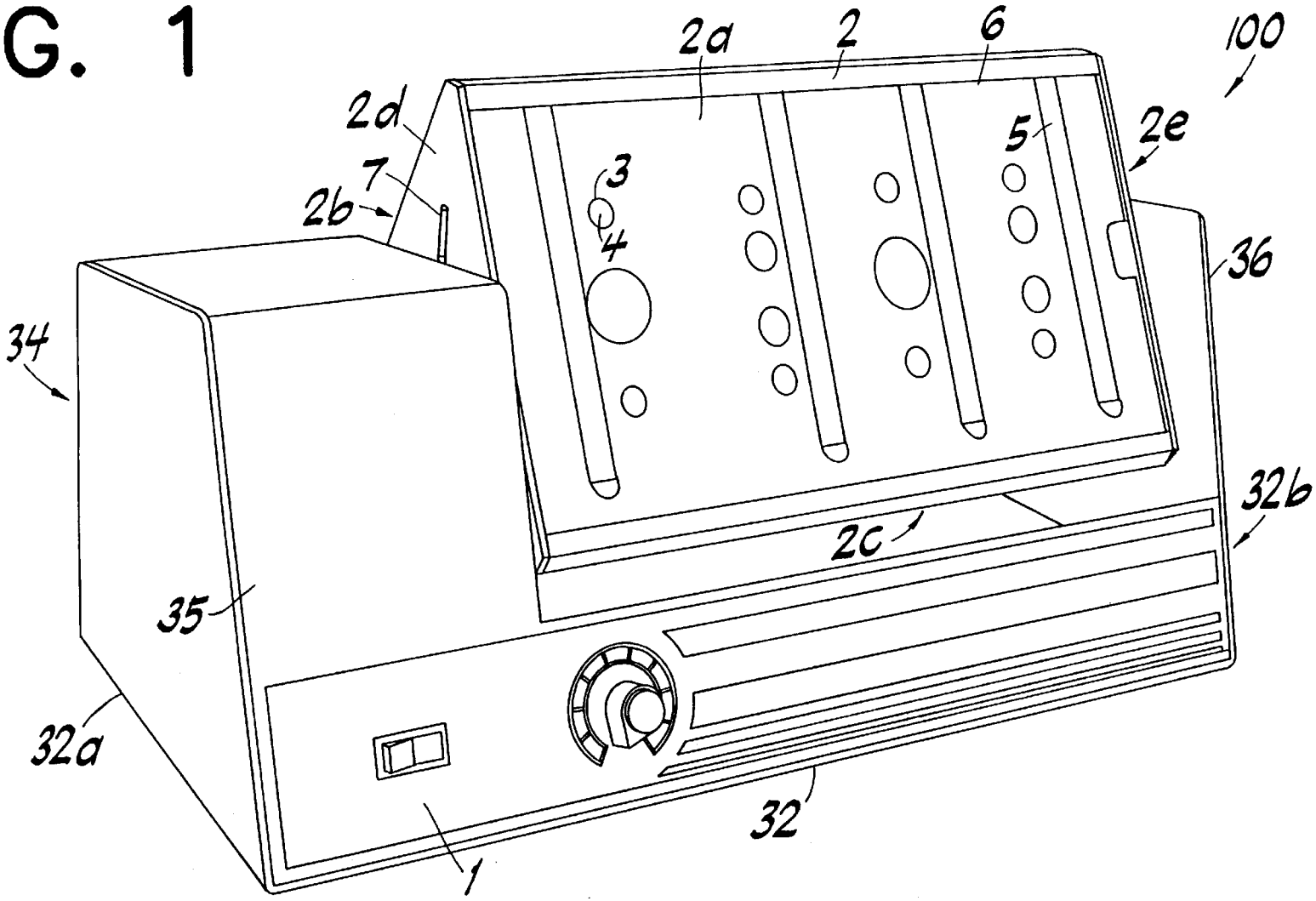
FIG. 1 is a perspective view of a combination rotator and rocker of an embodiment of the present invention.

FIG. 1 shows a combined rotator and rocker 100 according to one embodiment of the present invention. It includes a sheet metal housing 1 having a generally rectangular base 32 and opposite lateral ends 32*a*, 32*b*. Sides 34 and 36 are coupled to the ends 32*a* and 32*b*, respectively, and extend substantially perpendicularly up from the base 32.

A drum 2 has a body illustrated as having a substantially triangular cross section wherein the sides of the drum are defined by rectangular, flat side surfaces 2*a*, 2*b*, 2*c*. The body has two opposite end surfaces 2*d*, 2*e*. However, other shape cross-sections may fall within the scope of the invention. In other embodiments, the drum 2 may have a square or rectangular or another geometric shape cross section formed by flat sides and also having opposite end surfaces.

The drum 2 is disposed between the spaced apart side portions 34, 36. At least one of the side surfaces of the drum includes holes 3 of varying diameters for receiving various diameter tubes. Each hole is (or all holes together are) equipped with a retaining element 4. The retaining element may be, for example, foam having respective slits for receiving the tubes. When the element 4 is foam, it presses around the tubes to secure them in the holes 3.

The retaining element 4 may alternatively be one or more clips 46 (FIG. 3) formed of plastic or a suitable metal material.

The drum 2 is adapted to receive a blot (not shown). Blots are known to include, for example, a high binding capacity membrane (containing an electrophoretically separated protein and/or nucleic acid mixture) in a sealable plastic bag which is filled with a probe diluted in an incubation buffer. The blots require agitation to assure uniform exposure of the membrane to the probe and to diminish unspecific binding of the probe to the membrane.

To receive one or more blots, each side surface 2*a*, 2*b*, and 2*c* of the drum may include a slot 6 along one edge for receiving one or more spring clips 5 that extend across that surface. Preferably, each side surface 2*a*, 2*b*, and 2*c* includes two slots 6, each receiving two spring clips 5 mounted therein. The end of the spring clip 5 is fixed to the side surface 2*a*, 2*b* and/or 2*c* of the drum 2 at a slot 6 for causing the other end of the spring clip 5 to be biased toward the respective side surface 2*a*, 2*b* and/or 2*c*.

The spring clips 5 may be slid in or out of their slots to a suitable distance to clamp objects, such as sealed plastic bags containing liquid that washes around paper blots inside the bag as the drum 2 is rotated.

The drum 2 is rotatably coupled to the side portions 34, 36 of the base along a central axis of the drum 2 such that the drum 2 is rotatable about the central axis. Preferably, the side portion 34 includes a motor housing 35 which contains a gear motor 9 (FIG. 2), speed control and mechanisms for rotating the drum 2.

Figure 2:
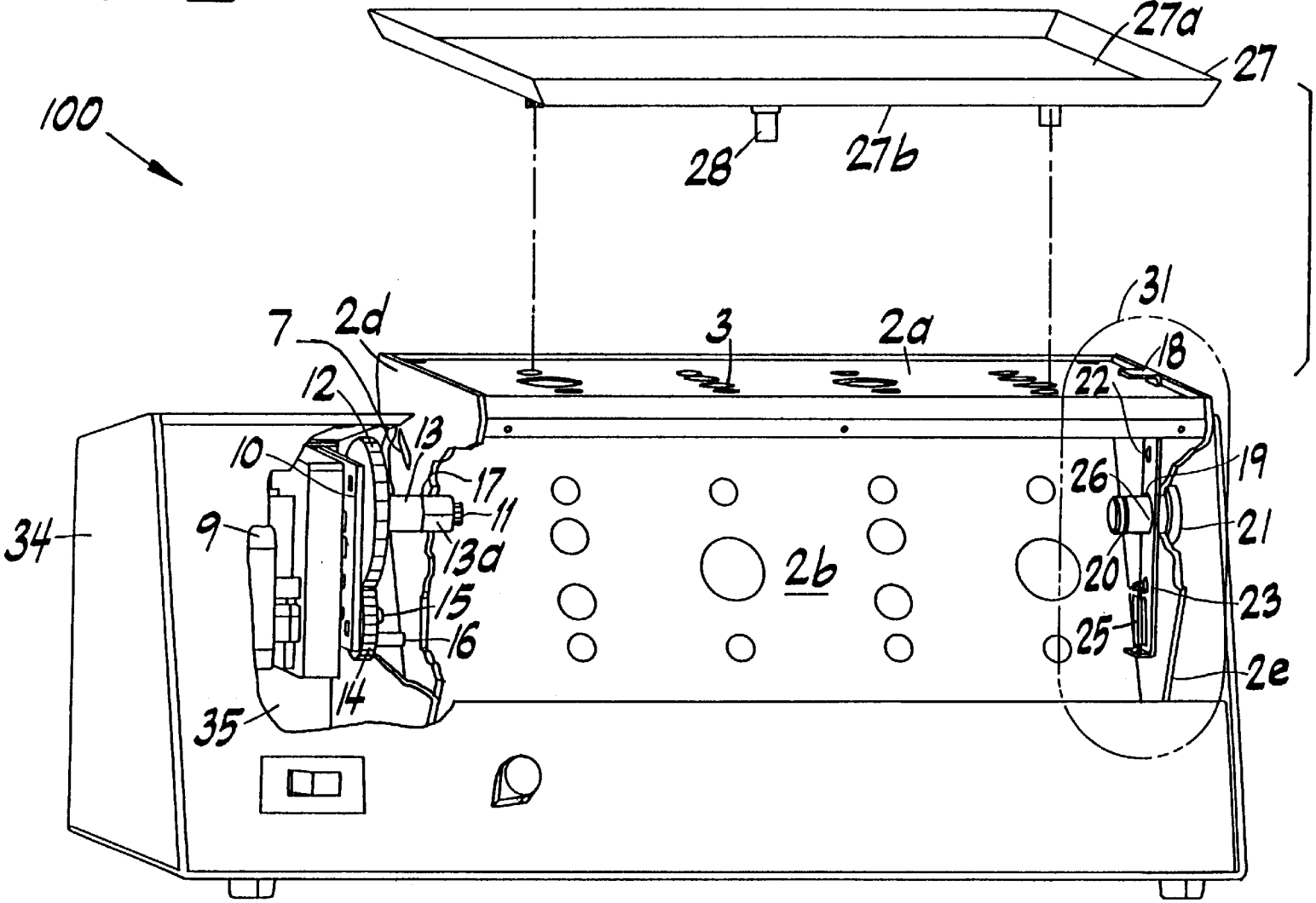
FIG. 2 shows a partially cut away view of the rotator and rocker of FIG. 1.

FIG. 2 shows a cut away view of the rotator and rocker 100. The motor housing 35 contains a gear motor 9 coupled to a mounting plate 10. The gear motor includes an output shaft 11 that extends from the gear motor 9, through the mounting plate 10 to engage, for example, the end portion 2*d* of the drum 2.

A large diameter gear 12, a first shaft portion 13 and a second portion 13*a* are disposed on the output shaft 11 one after the other axially. It is preferred that the first shaft portion 13 have a substantially round cross section and that the second shaft portion 13*a* have a substantially hexagonal cross section. Other shapes may be employed, as will be apparent from the description below. It is also preferred that the first and second shaft portions 13, 13*a* be formed of plastic.

The large diameter gear 12 and the first and second shaft portions 13, 13*a* rotate with the output shaft 11. The end surface 2*d* of the drum 2 facing the plate 10 includes a shaft hole 17 adapted to surround the first or the second shaft portions 13, 13*a* depending upon the lateral position of the drum with reference to the side portions 34 and 36. Specifically, the drum 2 may be moved into a first lateral position where the hole 17 engages the first, round shaft portion 13 or the drum 2 may be moved into a second lateral position (as shown) where the hole 17 engages the second profiled, e.g. hexagonal shaft portion 13*a*.

When the drum 2 is in the second lateral position (as shown), the second shaft portion 13*a* engages the shaft hole 17 such that the second shaft portion 13*a* is capable of exerting torsional force on the drum 2 for continuously rotating the drum 2 in one direction about the central axis. However, when the drum 2 is in the first lateral position, the first round shaft portion 13 extends through the shaft hole 17. The first shaft portion 13 is not capable of exerting substantial torsional force on the drum 2.

The shaft hole 17 and the cross section of the second shaft portion 13*a* preferably have a substantially hexagonal shape so that the second shaft portion 13*a* is capable of exerting a substantial torsional force on the drum 2 when in the second lateral position. In this way, the gear motor 9 drives the hexagonal shaft portion 13*a* which positively engages the hexagonal shaft hole 17, thus continuously rotating the drum 2. The first shaft portion 13 is preferably of a round cross section and cannot engage the hexagonal shape, shaft hole 17 to apply torsion.

A small diameter gear 14 is coupled to the mounting plate 10 at its center via a stub shaft 15. The gear 14 meshes with the large diameter gear 12 and rotates with respect to its center in an opposite direction to the rotation of the large diameter gear 12. A short axial length eccentric pin 16 disposed near the periphery of the small diameter gear 14 rotates eccentrically with respect to the stub shaft 15 at the center of the small diameter gear 14 when the gear 14 is driven by the large diameter gear 12. The eccentric pin 16 is of a length that when the drum 2 is in the second lateral position and the second shaft portion 13*a* is in the shaft hole 17, the eccentric pin 16 is out of engagement with the drum 2.

With reference to FIG. 1, the end surface 2*d* of the drum 2 facing toward the mounting plate 10 includes a plurality of slots 7, which extend generally radially with respect to the central axis of the drum 2. When the drum 2 is slid to the left toward the plate 10, the first (round) shaft portion 13 slides into the shaft hole 17, and the drum is free to rotate. When the drum 2 is further slid into the first lateral position, the eccentric pin 16 enters and rotatably and slidingly engages a slot 7 such that the eccentric rotation of the eccentric pin 16 as the gear 14 rotates moves the pin 16 along the slot 7 and also pivots the slot circumferentially to rock the drum 2 back and forth through an arc. This tilts the drum 2 about the central axis in response to the rotation of the output shaft 11 (i.e., the rocker mode).

When the drum 2 is in the second lateral position, wherein the hexagonal second shaft portion 13*a* is in the shaft hole 17, however, the relatively short eccentric pin 16 does not engage in the slot 7 and the drum 2 is only rotatable about the central axis in response to the torsional force applied by the second shaft portion 13*a* (i.e., the rotator mode).

Figure 2A:
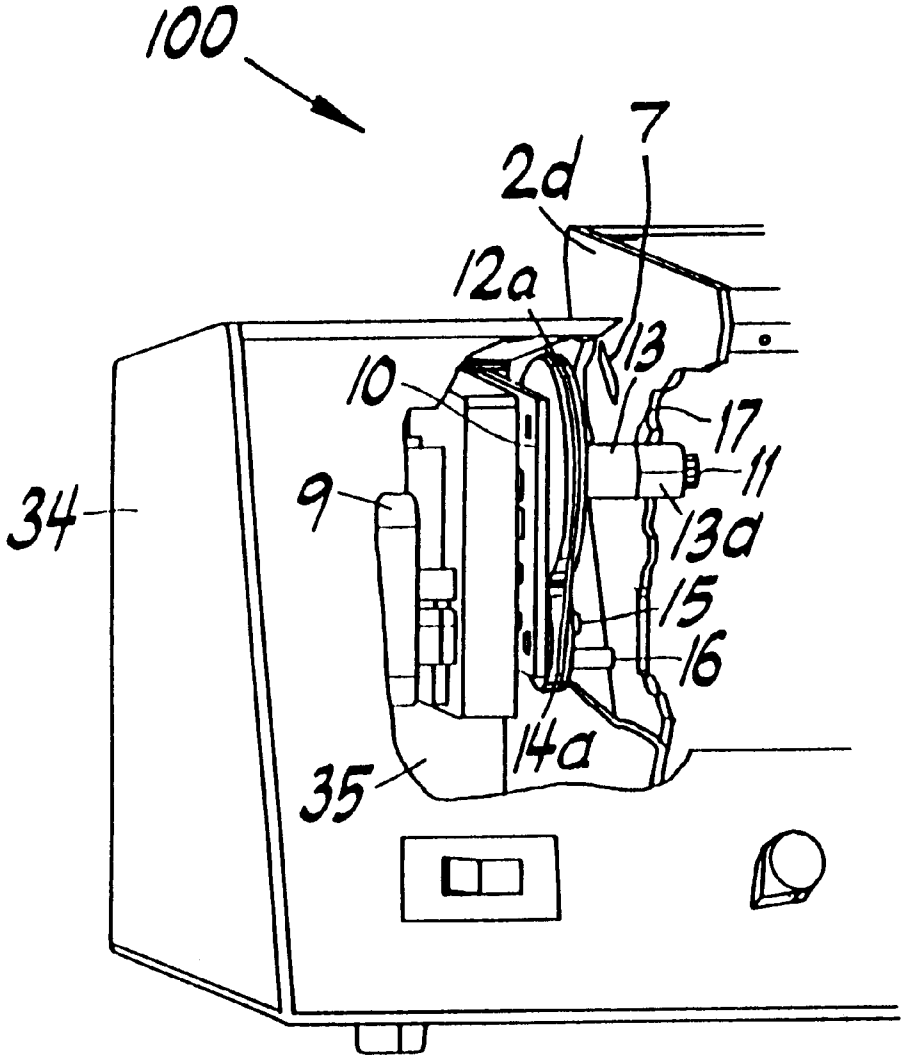
FIG. 2A shows an alternative embodiment of the rotator and rocker of FIG. 2.

It is noted that the large and small diameter gears 12, 14 may be replaced with pulleys 12*a*, 14*a* (FIG. 2*a*).

A locking mechanism 31 is preferably disposed at the opposite end of the drum 2 from the gear motor 9. The locking mechanism 31 alternately retains the drum 2 in the first or the second lateral position, depending upon whether the machine is being used in the rotator or rocker mode.

The locking mechanism 31 includes a mounting shaft 21 (preferably formed of plastic) having two axially spaced apart circumferential grooves 20, 26 which are selectively engaged with a locking bar 18. The locking bar 18 is in sliding engagement with the end surface 2*e* of the drum 2, preferably by way of slots 22 surrounding and communicating with standoffs 23. The bar 18 preferably includes an oversized hole 19 which is slid into engagement with a selected one of the grooves 20, 26. In particular, the thickness of the locking bar 18 is of such a size as to permit an edge of the oversized hole 19 to engage one of the grooves 20, 26 depending on the lateral position of the drum 2 and the axial position of the shaft 21. It is apparent to those skilled in the art that the oversized hole 19 may be interchanged with a lever (not shown) which engages the groves 20, 26 as desired.

The locking bar 18 is biased by spring 25 toward engagement with one or the other of the grooves 20, 26. To release the drum 2, the locking bar 18 is depressed until the edge of the oversized hole 19 (or lever) comes out of the groove 26, for example. This allows the drum 2 to be slid to the left. The locking bar 18 is released to be biased into the other groove 20, thus locking the assembly in place to the left.

It will be apparent to those skilled in the art from the above teaching that the motor 9 and output shaft 11 may be adapted to laterally shift with respect to the drum 2 so that the drum 2 may remain relatively laterally stationary. This may permit the first and second shaft portions 13, 13*a* to move into or out of the shaft hole 17, thereby alternating between the rocker and rotator modes, respectively.

The rotator and rocker 100 also includes a platform 27 having a top surface 27*a* and a bottom surface 27*b* for removable engagement with one of the side surfaces 2*a*, 2*b* and/or 2*c* of the drum 2. A plurality of locating pins 28 extend from the bottom surface 27*b* of the platform 27 for engaging the retaining element 4 of the drum 2. The locating pins 28 extend through holes 3 and may be retained, for example, in the slots of a foam material retaining element 4 behind the holes 3.

Alternatively, the retaining element 4 may include suitable clips (not shown) formed of plastic or a suitable metal material and adapted to engage the locating pins 28 of the tray to secure the platform 27 to the drum 2.

Trays (not shown) may be placed upon the platform 27 to be used for washing specimens. The platform 27 is suited for use when the drum 2 is in the first lateral position, i.e., the rocking mode.

Advantageously, the rotator and rocker 100 of the present invention provides a mechanism for selectively rotating or rocking a material without requiring the reversal of the gear motor or costly and complex means for determining the precise orientation of the drum 2. Further, the invention includes an improved apparatus for securing large membrane blots to the drum by providing spring clips on a large surface area of the drum for accepting the blots and subjecting the blots to rotational or rocking agitation.

Figure 3:
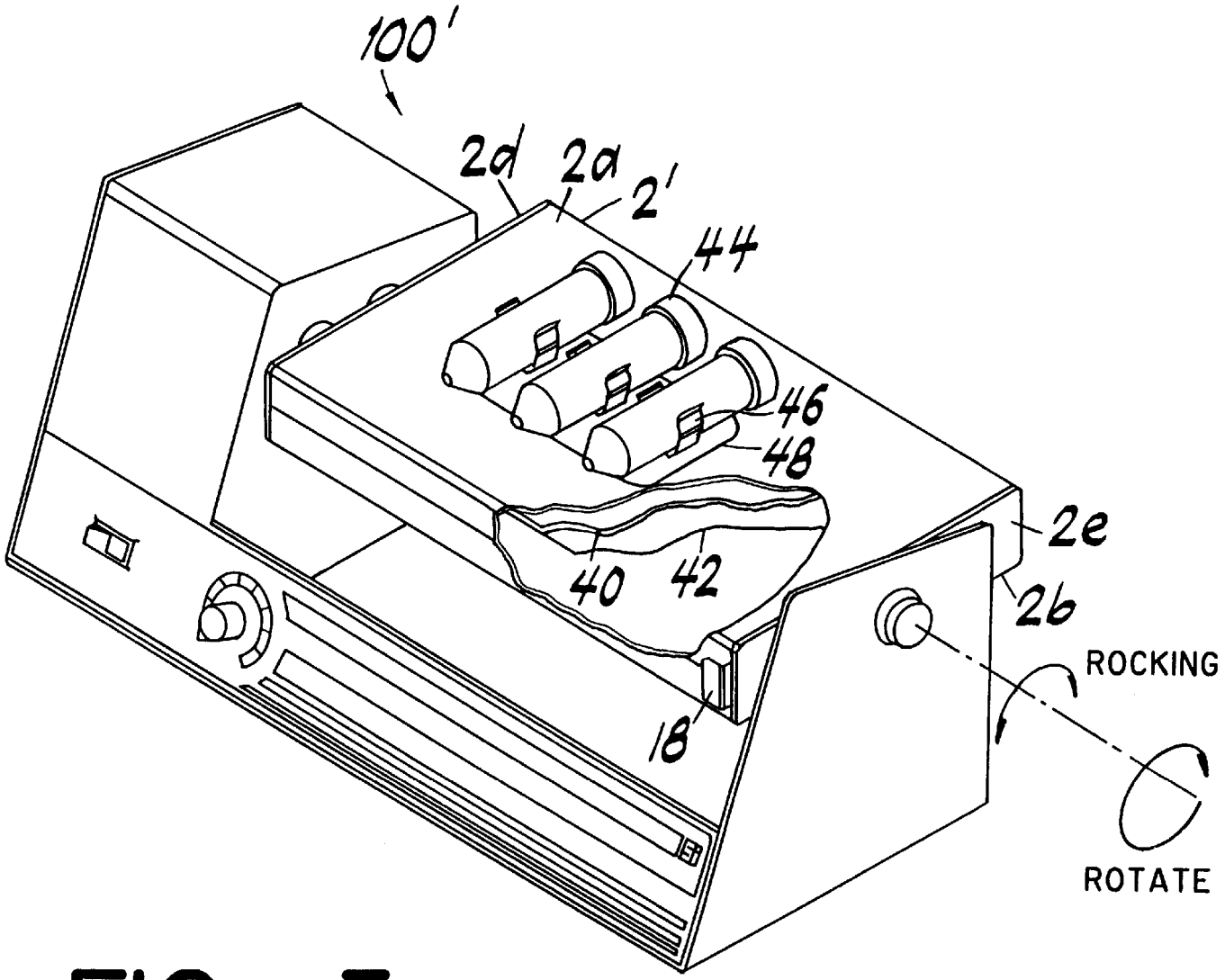
FIG. 3 shows a perspective view of a combination rotator and rocker of an alternative embodiment of the present invention.

Reference is now made to FIG. 3 which shows an alternative rotator and rocker 100' in accordance with the present invention. The rotator and rocker 100' of FIG. 3 is substantially the same as the rotator and rocker 100 of FIGS. 1 and 2 except for the construction of the drum 2'.

The rotator and rocker 100' of FIG. 3 includes a flat-shaped drum 2' with two rectangular surfaces 2*a*, 2*b* for receiving materials for rotation and/or rocking. The rectangular surfaces 2*a*, 2*b* are preferably made from thin gauge non-magnetic stainless steel.

Located within the drum 2 and adjacent the rectangular surfaces 2*a*, 2*b* are a substantially flat sheet of magnetized material 40 and a thin gauge magnetically attractable plate 42. Preferably, the magnetized material 40 is a flexible rubberized magnetized material mounted to the inside surface of both rectangular surfaces 2*a*, 2*b*. The plate 42 is preferably a thin gauge galvanized steel plate which substantially covers the entire surface of the magnetized material 40. The plate 42 is held in place by the magnetic attraction between the magnetized material 40 and the plate 42. The plate 42 is adapted to close and concentrate the magnetic field from the magnetized material 40.

The rectangular surfaces 2*a*, 2*b* may be adapted to receive tubes 44 for rotating or rocking. A clip plate 48 is formed of a magnetically attractable material and is placed on rectangular surfaces 2*a*, 2*b* as desired. Preferably, clip plate 48 is made from magnetically attractable stainless steel where the magnetic attraction between the clip plate 48 and the magnetized material 40 holds the plate 48 firmly to the surface 2*a* of the drum 2'.

The clip plate 48 includes spring clips 46 for springingly receiving tubes 44 and firmly coupling the tubes 44 to the drum 2'. The clip plates 48 may be equipped with spring clips 46 of differing sizes to receive different size tubes 44. Therefore, the number of tubes 44 mounted to the clip plate 48 may vary depending on the size of the tubes 44. It is apparent from the above teaching that a multitude of tubes 44 of different sizes may be simultaneously mounted to both surfaces 2*a*, 2*b* of the drum 2' using one or more clip plates 48.

It is noted that the drum 2' may alternatively receive one or more clip plates 48 which are themselves magnetized (or may cooperate with magnets). In this case, the drum 2' could be made of a magnetically attractable material (for example, magnetic stainless steel) to which the magnetized clip plates 48 would couple. The magnetized material 40 and the steel plate 42 may then be omitted from the drum 2'. Alternatively, the drum 2' would not itself be magnetically attractable but would include the magnetically attractable plate 42 therein which would provide the material for magnetic attraction with the magnetized clip plates 48.

Figure 4:
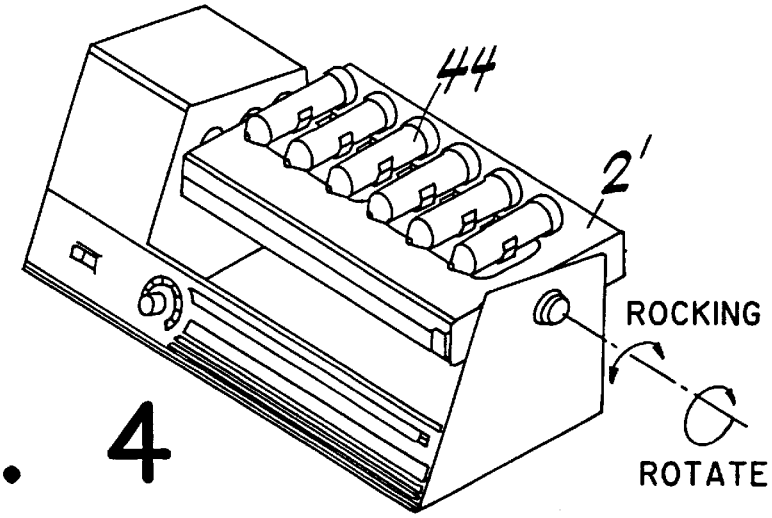
FIG. 4 shows a perspective view of the rotator and rocker of FIG. 3 adapted to retain tubes for end over and tumbling.
Figure 5:
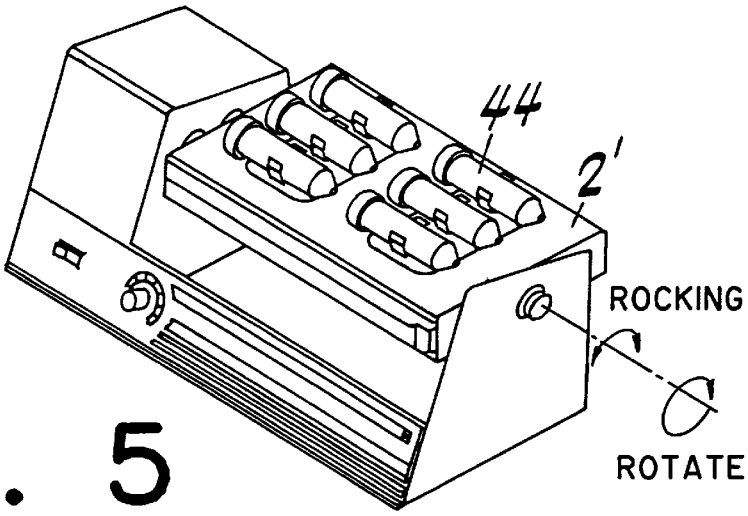
FIG. 5 is a perspective view of the rotator and rocker of FIG. 3 adapted to retain tubes for longitudinal rolling.
Figure 6:
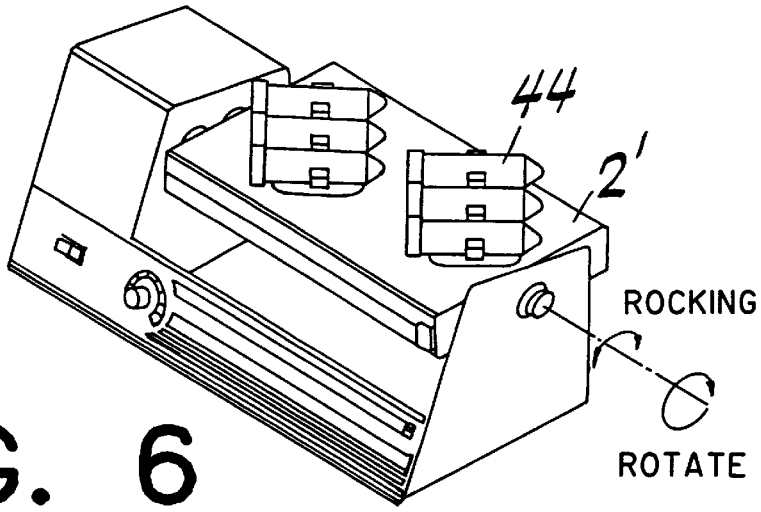
FIG. 6 shows the rotator and rocker of FIG. 3 adapted to receive tubes for a combination of rolling and tumbling.

Reference is now made to FIGS. 4–6 which show that the tubes 44 can be mounted to the drum 2' in any orientation allowing for different types of motion as the drum 2' rotates or rocks. FIG. 4 shows the tubes 44 mounted to the drum 2' to facilitate end over end tumbling when the drum is rotated. When the drum 2' is rocked, the tubes 44 are shaken longitudinally. FIG. 5 shows the tubes 44 mounted to the drum 2' in order to facilitate longitudinal rolling when the drum 2' is rotated. When the drum 2' is rocked, the tubes 44 are shaken with a longitudinal rolling motion. FIG. 6 shows the tubes 44 mounted to the drum 2' to facilitate a combination of rolling and tumbling motions, referred to as wobbling.

With reference to FIG. 3, the drum 2' of the rotator and rocker 100' may be operated in the rocking or rotating mode in the same way as the rotator and rocker 100 of FIGS. 1 and 2. Thus, the drum 2' of FIG. 3 unlocks, shifts into either the first lateral position or second lateral position and locks in that position to change between the rocking or rotating mode.

Figure 7:
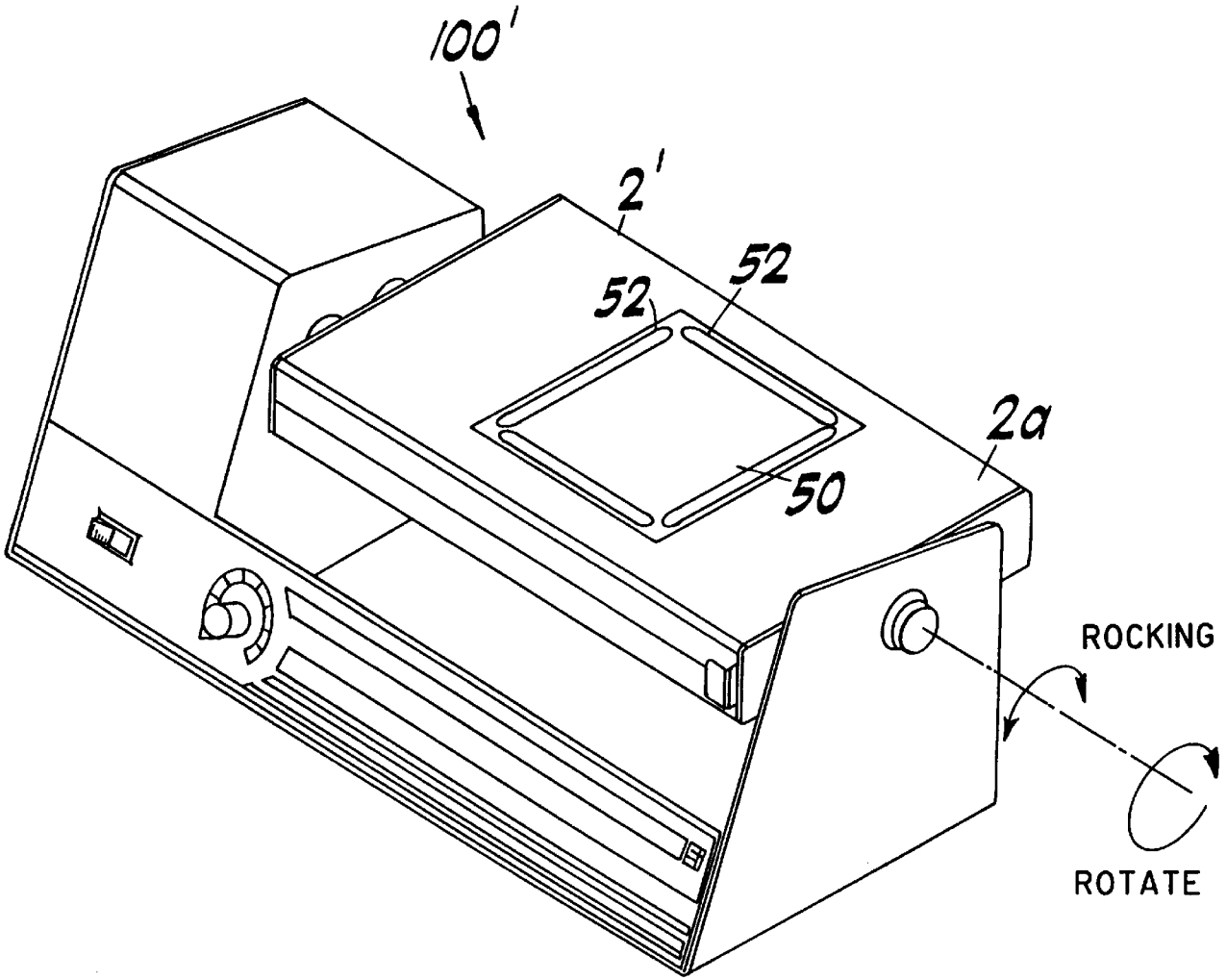
FIG. 7 shows a perspective view of the rotator and rocker of FIG. 3 including elements for retaining a bag to a drum of the rotator and rocker.

Reference is now made to FIG. 7 which shows the drum 2' adapted to receive bag-type containers, e.g. blot bags 50. Blot bag 50 is placed on, for example, rectangular surface 2*a* of the drum 2'. Magnetically attractable strips 52 (or metal strips, preferably formed from magnetically attractable stainless steel) are placed around the periphery of the bags 50. The magnetic attraction of the metal strips 52 to the magnetized material 40 beneath the surface 2*a* of the drum 2' secures the edges of the bag 50 and holds the bag 50 in place while it is rotated or rocked with the drum 2'.

It is apparent to those skilled in the art from the above teaching that a multitude of bags 50 may be mounted to both surfaces 2*a*, 2*b* of the drum 2'. It is also apparent that both bags 50 and tubes 44 may be mounted to the drum 2' at one time and in any orientation to achieve different mixing actions.

Figure 8:
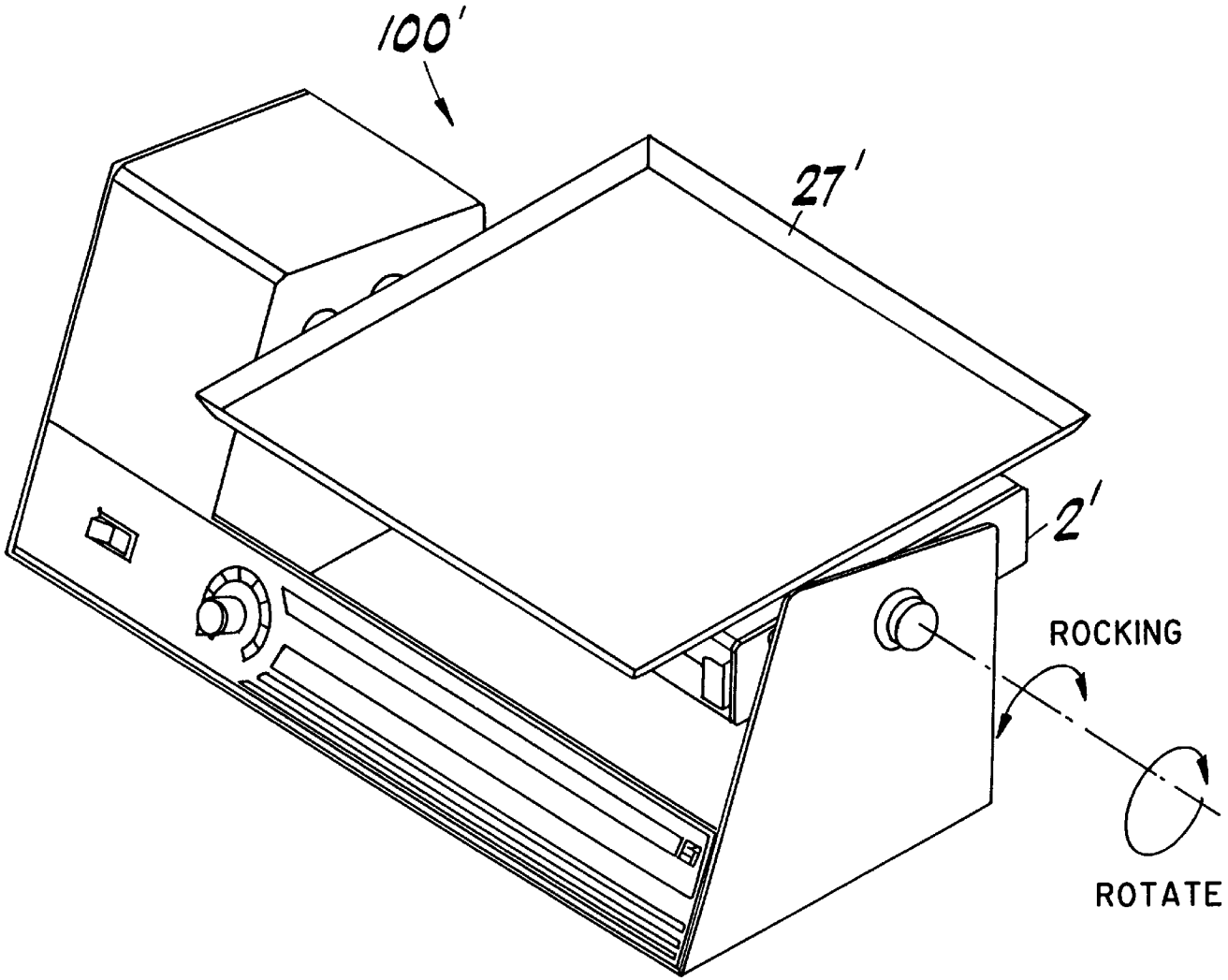
FIG. 8 is a perspective view of the rotator and rocker of FIG. 3 which includes a coated magnetic steel tray.

Reference is now made to FIG. 8 which shows the drum 2' adapted to receive a platform 27'. The platform 27' is preferably formed of a coated magnetically attractable steel and is held in place by the attraction of the steel to the magnetized material 40 beneath the surface 2*a* of the drum 2'. It will be apparent to those skilled in the art that trays (not shown) of different sizes containing, for example, liquids may be placed on the platform 27' to be rocked with the drum 2'.

Figure 9:
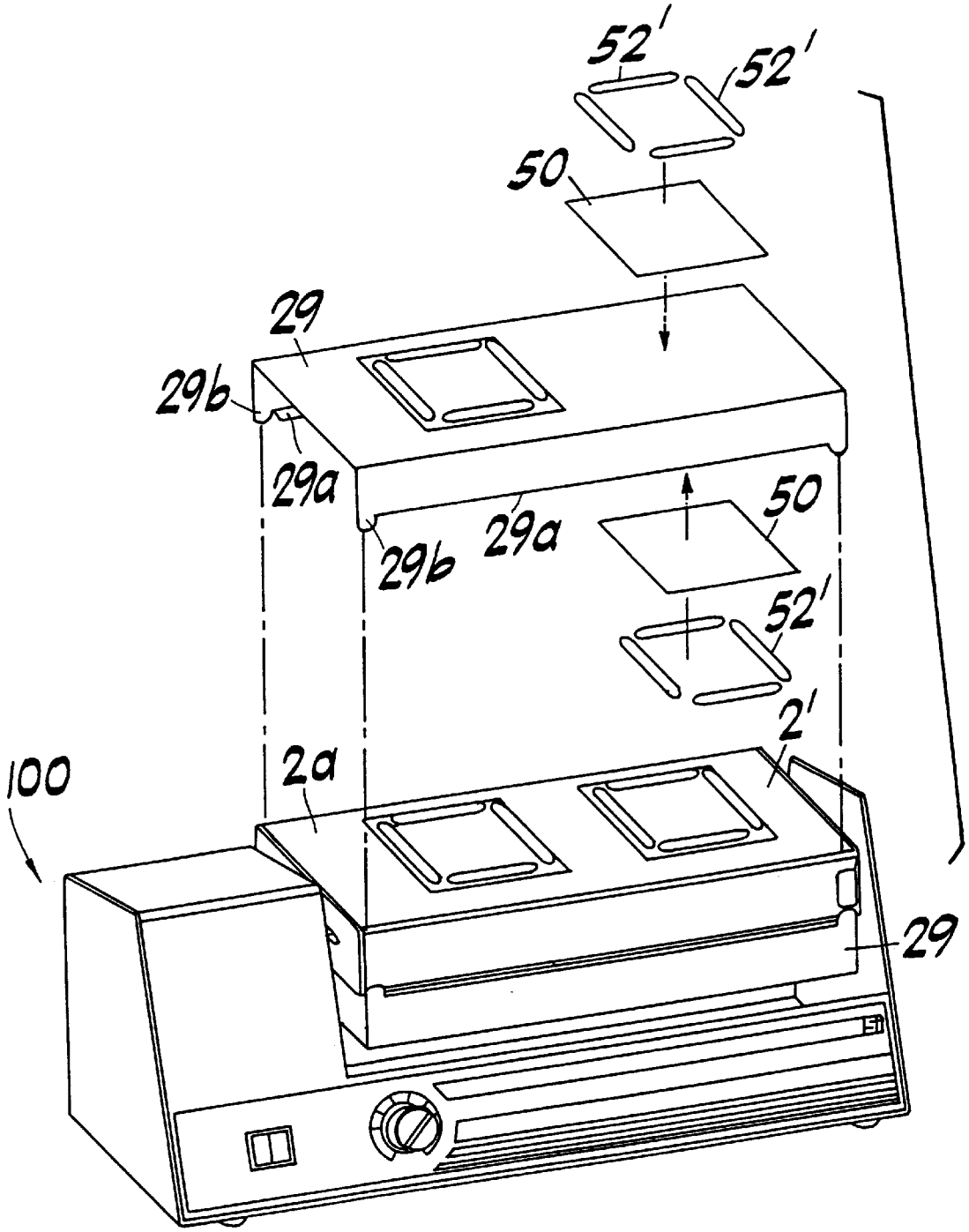
FIG. 9 is a perspective and exploded view of the rotator and rocker of FIG. 3 which includes expansion trays.

Reference is now made to FIG. 9 which shows a perspective and partially exploded view of the rotator and rocker 100' adapted to receive expansion trays (or platforms) 29. The expansion trays 29 are adapted to magnetically couple to one or both of the flat side surfaces 2*a* and 2*b*. In particular, the expansion trays 29 include one or more flanges 29*a* and one or more tabs 29*b*. Preferably, the expansion trays 29 include one flange 29*a* along each longitudinal side of the tray 29. It is also preferred that the expansion tray 29 include one tab 29*b* at each end of each longitudinal side. The flanges 29*a* are magnetically attractable to the magnetized material 40 within the drum 2'. It is preferred that the expansion tray 29 be formed from magnetically attractable stainless steel.

As shown, two expansion trays 29 may be directly coupled to each flat surface 2*a* and 2*b* of the drum 2'. The expansion trays 29 provide additional surfaces for receiving blot bags 50. The blot bags 50 may be disposed on the top or bottom surfaces of each expansion tray 29 to maximize the number of blot bags 50 to be coupled to the drum 2'.

One or more magnetized strips 52' are used to magnetically couple the blot bags 50 to the top and/or bottom surfaces of the expansion trays 29. As the magnetic strips 52' are magnetized, they are attractable to the magnetically attractable stainless steel of the expansion tray 29.

The foregoing description of the preferred embodiment of the present invention has been provided for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A combined rotator and rocker for agitating contained materials, the rotator and rocker comprising:

a base having first and second opposite side portions;

a drum having at least one side surface for receiving the contained material, a pair of opposing end surfaces, and a central axis passing through the end surfaces;

the drum being rotatable with respect to the base and also being laterally movable along the central axis with respect to the base between first and second lateral positions;

first means at the drum and the base adapted to permit the drum to rock through an arc about the central axis when the drum is in the first lateral position; and second means at the drum and the base adapted to permit the drum to continuously rotate in one direction about the central axis when the drum is in the second lateral position.

2. The rotator and rocker of claim 1, further comprising a motor disposed in the base and having an output shaft, the first means comprising the output shaft being coupled to the drum for rocking the drum about the central axis when the drum is in the first lateral position.

3. The rotator and rocker of claim 2, wherein the first means comprises a rotatable eccentric pin coupled to the output shaft for rotating eccentrically, the eccentric pin engaging one of the end surfaces of the drum for rocking the drum about the central axis as the eccentric pin rotates while in engagement with the end surface of the drum.

4. The rotator and rocker of claim 1, further comprising a motor disposed in the base and having an output shaft, the first and the second means being coupled with the output shaft.

5. The rotator and rocker of claim 4, wherein the output shaft includes a first shaft portion which is part of the first means and a second shaft portion which is part of the second means, the first and second shaft portions being at axially separate locations along the output shaft such that only one of the first and second shaft portions engages the drum at each of the first and second lateral positions the drum.

6. The rotator and rocker of claim 5, wherein the second shaft portion has a profile and one of the end surfaces of the drum has a corresponding profile that receives the profile of the second shaft portion such that rotation of the output shaft, through the second shaft portion, rotates the drum.

7. The rotator and rocker of claim 6, wherein the first shaft portion is not similarly profiled, so that when the first shaft portion is received at the one end surface of the drum, the rotation of the output shaft does not rotate the drum.

8. The rotator and rocker of claim 7, wherein the second shaft portion has a substantially hexagonal cross section and the first shaft portion has a substantially round cross section.

9. The rotator and rocker of claim 7, wherein the one end surface of the drum includes a hole which receives the second shaft portion when the drum is in the second lateral position such that the output shaft exerts torsional force on the drum for rotating the drum about the central axis.

10. The rotator and rocker of claim 9, wherein the hole is correspondingly substantially hexagonal in shape.

11. The rotator and rocker of claim 7, further comprising:

a first gear driven by the output shaft;

a second gear driven by the first gear and including an eccentric pin located eccentrically on the second gear;

the one end surface of the drum including at least one slot radially disposed with respect to the central axis, the eccentric pin rotatably and slidingly engaging the slot for rocking the drum back and forth during rotation of the output shaft when the drum is in the first lateral position.

12. The rotator and rocker of claim 11, wherein the eccentric pin is at the same end surface of the drum as the output shaft.

13. The rotator and rocker of claim 11, wherein the eccentric pin is shaped and placed for disengaging from the slot when the drum is in the second lateral position.

14. The rotator and rocker of claim 7, further comprising:

a first pulley driven by the output shaft;

a second pulley driven by the first pulley and including an eccentric pin located eccentrically on the second pulley;

the one end surface of the drum including at least one slot radially disposed with respect to the central axis, the eccentric pin rotatably and slidingly engaging the slot for rocking the drum back and forth during rotation of the output shaft when the drum is in the first lateral position.

15. The rotator and rocker of claim 1, further comprising a locking mechanism for alternately retaining the drum in one of the first and second lateral positions.

16. The rotator and rocker of claim 15, wherein one end surface of the drum has a hole therein; the locking mechanism including:

a mounting shaft supported on the base and extending through the hole of the drum, the mounting shaft having first and second axially spaced apart circumferential grooves; and a locking bar coupled to the drum and having an edge which is selectively engageable with one of the first and second circumferential grooves for:

(i) retaining the drum in the first lateral position when the drum is shifted laterally such that the edge of the locking bar engages the first circumferential groove; and (ii) retaining the drum in the second lateral position when the drum is shifted laterally such that the edge of the locking bar engages the second circumferential groove.

17. The rotator and rocker of claim 16, further comprising a spring biasing the locking bar into one of the first and second grooves.

18. The rotator and rocker of claim 1, wherein the at least one side surface of the drum includes a plurality of holes therein and a retaining element disposed behind the holes to receive and retain tubes.

19. The rotator and rocker of claim 18, further comprising:

a platform having a top and a bottom; and locator means at the bottom of the platform for engaging the side surface of the drum for securing the platform to the drum.

20. The rotator and rocker of claim 19, wherein the retaining element includes resilient foam adapted for receiving the locator means.

21. The rotator and rocker of claim 19, wherein the retaining element includes clip means for receiving the locator means.

22. The rotator and rocker of claim 21, wherein the clip means is formed from plastic or metal.

23. The rotator and rocker of claim 1, further comprising:

a platform having a top and a bottom; and locator means at the bottom of the platform for engaging the at least one side surface of the drum for securing the platform to the drum.

24. The rotator and rocker of claim 1, further comprising at least one spring clip mounted on the at least one side surface for receiving and retaining a container.

25. The rotator and rocker of claim 24, wherein the spring clip has a first end fixedly mounted to the side surface of the drum and a second end biasing toward the side surface of the drum.

26. The rotator and rocker of claim 24, wherein the container is a blot bag.

27. A combined rotator and rocker for agitating contained materials, the rotator and rocker comprising:

a base having first and second opposite side portions; and a drum including:

at least one drum wall having an outside surface for receiving the contained material and an oppositely disposed inside surface;

a magnetized sheet coupled to the inside surface of the drum wall for permitting the contained material to be attached to the outside surface of the drum wall;

a pair of opposing end surfaces having a central axis passing through the end surfaces;

the drum being rotatable with respect to the base and adapted to rock through an arc about the central axis or continuously rotate in one direction about the central axis.

28. The rotator and rocker of claim 27, wherein the magnetized sheet is a substantially flexible rubberized magnetic material.

29. The rotator and rocker of claim 28, wherein the drum wall is formed of a substantially thin non-magnetically attractable material.

30. The rotator and rocker of claim 29, wherein the drum wall is formed of a substantially thin non-magnetically attractable stainless steel.

31. The rotator and rocker of claim 27, further including a magnetically attractable plate coupled on a side of the magnetized sheet opposite the inside surface of the drum wall and adapted to close and concentrate a magnetic field propagating from the magnetized sheet.

32. The rotator and rocker of claim 31, wherein the magnetically attractable plate is formed of thin gauge galvanized steel and substantially covers the magnetized sheet.

33. The rotator and rocker of claim 27, further comprising a clip element adapted to magnetically and releasably couple to the outside surface of the drum wall and releasably receive one or more tubes for rotating or rocking.

34. The rotator and rocker of claim 33, wherein the clip element is at least partially formed from steel.

35. The rotator and rocker of claim 33, wherein the clip element is at least partially formed from magnetically attractable stainless steel.

36. The rotator and rocker of claim 33, wherein the clip element is adapted to receive a plurality of tubes of potentially differing sizes.

37. The rotator and rocker of claim 33, wherein the clip element is adapted to be oriented in a plurality of directional orientations such that the tubes may be likewise oriented in a plurality of directional orientations.

38. The rotator and rocker of claim 37, wherein the clip element is adapted to permit end over end tumbling, longitudinal rolling, or wobbling of the tubes when the drum is rotated.

39. The rotator and rocker of claim 37, wherein the clip element is adapted to permit longitudinal shaking, longitudinal rolling, or wobbling of the tubes when the drum is rocked.

40. The rotator and rocker of claim 27, further comprising one or more magnetically attractable strips adapted to magnetically and releasably couple to the outside surface of the drum wall and releasably receive one or more containers for rotating or rocking.

41. The rotator and rocker of claim 40, wherein the containers are bags.

42. The rotator and rocker of claim 40, wherein the containers are blot bags.

43. The rotator and rocker of claim 27, further comprising a platform formed at least partially of magnetically attractable material adapted to magnetically and releasably couple to the outside surface of the drum wall, the platform being adapted to receive material for rocking.

44. The rotator and rocker of claim 43, wherein the platform is formed in the shape of a shallow tray for receiving the material for rocking.

45. The rotator and rocker of claim 43, wherein the top and bottom surfaces of the platform are further adapted to receive one or more magnetized strips for magnetically and releasably coupling to the surfaces of the platform and for releasably coupling one or more containers to the platform for rotating or rocking.

46. The rotator and rocker of claim 45, wherein the containers are bags.

47. The rotator and rocker of claim 46, wherein the containers are blot bags.

48. A combined rotator and rocker for agitating contained materials, the rotator and rocker comprising:

a base having first and second opposite side portions;

a drum including:

at least one drum wall having an outside surface for receiving the contained material and an oppositely disposed inside surface;

a magnetically attractable member disposed [with] proximate to the drum; and a pair of opposing end surfaces having a central axis passing through the end surfaces;

the rotator and rocker further comprising a magnetized member adapted to magnetically couple to the drum via the magnetically attractable member, the magnetized member being adapted to operatively couple the contained material to the outside surface of the drum wall, the drum being rotatable with respect to the base and adapted to rock through an arc about the central axis or continuously rotate in one direction about the central axis.

49. The rotator and rocker of claim 48, wherein the drum wall is at least partially formed of the magnetically attractable member.

50. The rotator and rocker of claim 48, further comprising a clip element having a magnetized element for magnetically and releasably coupling to the outside surface of the drum wall and releasably receiving one or more tubes for rotating or rocking.

51. The rotator and rocker of claim 50, wherein the clip element is adapted to receive a plurality of tubes of potentially differing sizes.

52. The rotator and rocker of claim 50, wherein the clip element is adapted to be oriented in a plurality of directional orientations such that the tubes may be likewise oriented in a plurality of directional orientations.

53. The rotator and rocker of claim 50, wherein the clip element is adapted to permit end over end tumbling, longitudinal rolling, or wobbling of the tubes when the drum is rotated.

54. The rotator and rocker of claim 50, wherein the clip element is adapted to permit longitudinal shaking, longitudinal rolling, or wobbling of the tubes when the drum is rocked.

55. The rotator and rocker of claim 48, further comprising one or more magnetized strips adapted to magnetically and releasably couple to the outside surface of the drum wall and releasably receive one or more containers for rotating or rocking.

56. The rotator and rocker of claim 48, wherein the materials are contained in bags.

57. The rotator and rocker of claim 56, wherein the materials are contained in blot bags.

* * * * *